US005175990A

United States Patent [19]

Fritschi et al.

[11] Patent Number: 5,175,990

[45] Date of Patent: Jan. 5, 1993

[54] BOBBIN CONVEYING SYSTEM FOR A SPINNING MACHINE

[75] Inventors: Isidor Fritschi, Andelfingen; Urs Meyer, Niederglatt; Jörg Wernli, Winterthur, all of Switzerland

[73] Assignee: Rieter Machine Works, Ltd., Winterthur, Switzerland

[21] Appl. No.: 499,381

[22] PCT Filed: Sep. 21, 1989

[86] PCT No.: PCT/EP89/01097

§ 371 Date: Jul. 11, 1990

§ 102(e) Date: Jul. 11, 1990

[87] PCT Pub. No.: WO90/03460

PCT Pub. Date: Apr. 5, 1990

[30] Foreign Application Priority Data

| | | | |
|---|---|---|---|
| Sep. 24, 1988 | [CH] | Switzerland | 3547/88 |
| Mar. 23, 1989 | [DE] | Fed. Rep. of Germany | 3909679 |
| Mar. 31, 1989 | [DE] | Fed. Rep. of Germany | 3910441 |

[51] Int. Cl.[5] ..... D01H 9/18

[52] U.S. Cl. ..... 57/281; 57/90; 242/35.5 A

[58] Field of Search ..... 57/90, 281; 242/35.5 A

[56] References Cited

U.S. PATENT DOCUMENTS

| | | | |
|---|---|---|---|
| 3,382,659 | 5/1968 | Schultz et al. | 57/281 |
| 3,905,184 | 9/1975 | Takai et al. | 57/274 |
| 3,935,821 | 2/1976 | Maier et al. | 57/281 X |
| 4,841,720 | 6/1989 | Kawasaki et al. | 57/281 |
| 4,964,269 | 10/1990 | Dinkelman | 57/281 |

FOREIGN PATENT DOCUMENTS

| | | |
|---|---|---|
| 61432 | 9/1982 | European Pat. Off. . |
| 3544560 | 7/1986 | Fed. Rep. of Germany . |
| 3712027 | 10/1987 | Fed. Rep. of Germany . |
| 3637172 | 5/1988 | Fed. Rep. of Germany . |
| 1168638 | 10/1969 | United Kingdom . |

*Primary Examiner*—Joseph J. Hall, III
*Attorney, Agent, or Firm*—Francis C. Hand

[57] ABSTRACT

An endless conveyor for ring spinning machines comprises bobbin pegs (13) for receiving full and/or empty bobbins which seen in the conveying direction of the endless conveyor (17) must assume an exact position on the endless conveyor (17) in order in a predetermined bobbin change position to come into alignment with a spinning point (11) or other bobbin support arrangement and thus ensure a perfect bobbin transfer from or to the bobbin peg (13). Each bobbin peg (13) is mounted on the endless conveyor (17) adjustably in the conveying direction via a driver (19).

10 Claims, 7 Drawing Sheets

Figure 3:
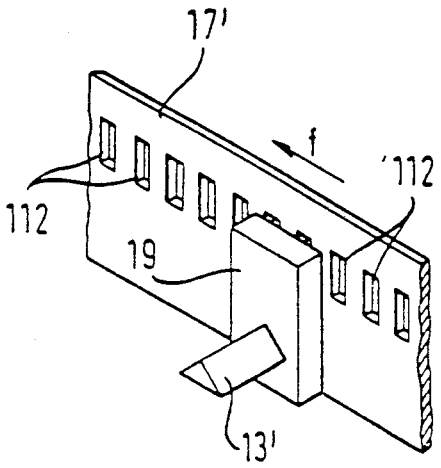

Fig.1
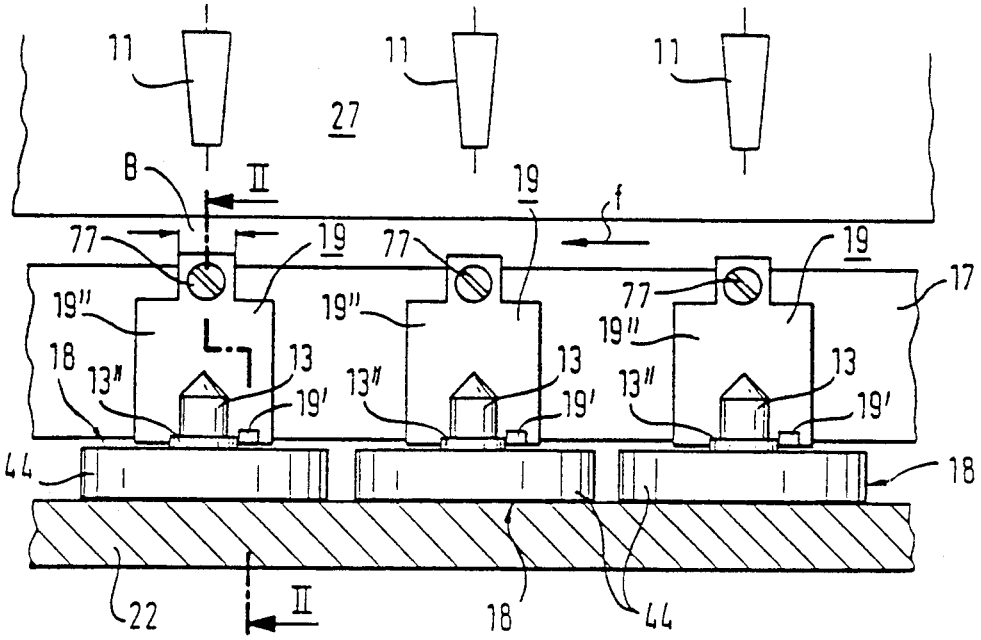
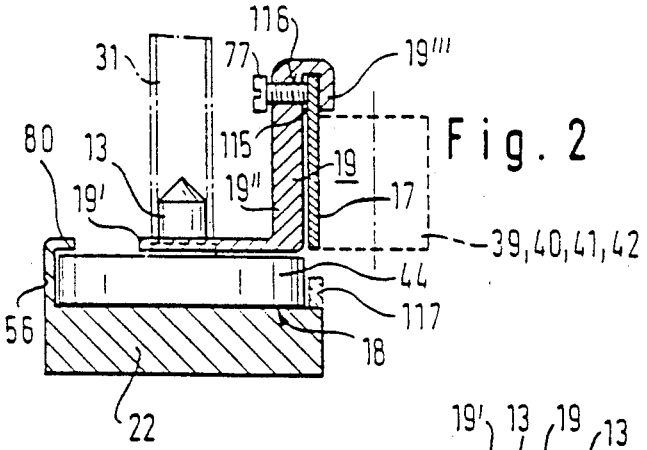
Fig. 2
Fig.11
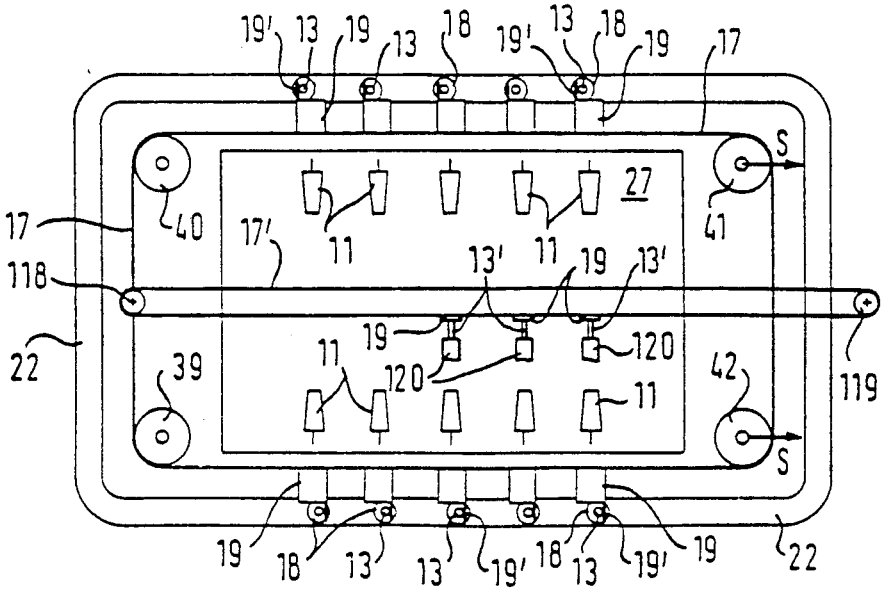

BOBBIN CONVEYING SYSTEM FOR A SPINNING MACHINE

The invention relates to a spinning machine, in particular a ring spinning machine or ring frame. More particularly, this invention relates to the bobbin conveying system for a spinning machine.

In a known ring spinning machine of this type (GB-PS 1,168,638) the bobbin pegs are mounted directly on the endless conveyor constructed as horizontal conveyor belt. The endless conveyor is generally constructed as a steel band or belt which distorts as little as possible so that the predetermined intervals of the bobbin pegs, which must coincide exactly with the intervals of the spinning points or stations, remain unchanged even on relatively long operation of the machine.

Whereas in the ring spinning machine according to GB-PS 1,168,638 the bobbin pegs are arranged at half the interval of the spinning stations or points in order to be able to receive during doffing temporarily simultaneously an empty bobbin and a full bobbin (cops) of the associated spinning point, it is also possible to provide on the endless conveyor constructed as belt or band, bobbin pegs only at the interval of the spinning points, in which case at each spinning point an additional peg must then be provided in order to receive temporarily one of the bobbins to be replaced on a bobbin change (U.S. Pat. No. 3,905,184).

It is further already known (EP-A-O 061 432) to provide on each machine side of a ring spinning machine or frame an endless conveyor, both runs of each endless conveyor being equipped with bobbin pegs so that when changing a full bobbin (cops) for an empty bobbin, the full bobbin can be fitted onto the empty bobbin peg whilst thereafter an empty bobbin is removed from the bobbin peg of the other run associated with the same spinning point and fitted onto the spindle of the spinning point. In this known ring spinning machine, as well, the bobbin pegs are connected via angle pieces directly to the endless conveyor.

It is also already known (JP-OS 57-161 134) to use the peg trays employed in the spooling frame following the ring spinning machine also as empty bobbin supply means or full bobbin removal means by displacing the peg trays, which generally consist of a circular disc and a center peg arranged perpendicularly thereon, in a guide rail extending round the ring spinning machine, the diameter, in particular the length of a peg tray, being slightly smaller than the spacing of two adjacent spinning points. The individual peg trays are in contact with each other and are advanced by exerting a force on one or more peg trays, the thrust being at least partially transmitted by the direct contact of the peg trays. A conveying apparatus for such peg trays is also known from DE-OS 3,544,560.

A disadvantage in the ring spinning machine according to JP-OS 57-161 134 is that the bobbin pegs are not exactly in alignment with the spinning points when a group of peg trays with empty bobbins has been pushed on one machine side in front of the associated spinning points. Consequently, before the bobbin change can be performed in the known ring spinning machine, a rake must be pushed at right-angles to the spinning machine longitudinal axis between the peg trays so that the intervals of the adjacent bobbin pegs are exactly coordinated with the intervals of the adjacent spinning stations.

In a similar bobbin transport means (DE-OS 3,712,027) a reciprocating rail or the like extending along the spinning points is used and cooperates with peg trays displaceable in a guide rail in such a manner that the trays are displaced stepwise up to the associated spinning point. To ensure that the peg trays are exactly aligned with the associated spinning point they must either have a length exactly equal to the spinning point spacing or blocking elements pivotal in pawl-like manner must be provided on the reciprocating rail and disposed exactly at the intervals of the spinning points so that the blocking elements ensure an exact alignment of the peg trays with the associated spinning point even when the holding trays are not in contact with each other. However, the pawls must be mounted with high production expenditure exactly at the correct point of the rail.

The problem underlying the present invention resides in providing a spinning frame of the aforementioned type in which, after assembly of the endless conveyor and in particular after establishing the longitudinal tension of the endless conveyor necessary for operation, the support pegs can be attached in simple manner and with little constructional expenditure to a defined point of the endless conveyor and then fixed so that when the endless conveyor is arranged in the bobbin change position, each support peg is located exactly at the associated spinning point or at the associated bobbin support arrangement at which a bobbin transfer or bobbin change is to be effected.

Briefly, the invention is directed to a spinning machine having a plurality of spinning positions disposed at predetermined intervals and an endless conveyor disposed for travel along the spinning positions. In accordance with the invention, in one embodiment, the spinning machine includes a plurality of drivers which are mounted on the conveyor at intervals corresponding to the predetermined intervals of the spinning positions, with each driver being adjustably mounted on the conveyor to be individually adapted to a respective spinning position. In this embodiment, the spinning machine also has a support rail extending along the spinning positions and a plurality of bobbins peg trays which are slidably mounted on the support rail. Each peg tray is also disposed in contact with a respective driver for pushing along the rail in response to movement of the conveyor.

The idea underlying the invention thus resides not in fixedly mounting the drivers from the start on the endless conveyor preferably constructed as a vertically running steel band or belt but in providing a possibility of adjusting the drivers even after assembly of the endless conveyor on the spinning machine at least within certain limits in the conveying direction relative to the endless conveyor and then fixing them in the adjustment position found.

In this manner, uncontrolled elongations of the endless conveyor on assembly and subjecting to tension in the spinning machine cannot have any disadvantageous effect on the exact positioning of the drivers relatively to the spinning points or the bobbin removal points because this positioning is carried out exactly afterwards.

The support rail in the embodiment takes up the weight of the peg trays or pegs.

It is particularly advantageous for the drivers to be continuously adjustable via a releasable clamp connection because in this manner even the smallest inaccuracies in the arrangement of the drivers on the endless conveyor can be eliminated.

In many cases however it also suffices if only an adjustment in small increments or steps is possible. For example, the conveyor can be provides with a plurality of equi-spaced slots while each driver has a projection for selectively fitting in one of the slots to adjustably mount a respective driver on the belt. Alternatively, the belt may be provided with projections while the driver is provided with slots for receiving the projections. In either case, the slots and projections in the belt has spacings of from 2 to 3 millimeters, and preferably about 2.5 millimeters while the width of the slots or projections is from 0.5 to 1.5 millimeters and preferably 1 millimeter. This embodiment has the advantage that the moving of the drivers from one projection to the next or from one hole to the next can be carried out relatively simply and generally without releasing any clamping means. Thus, this embodiment is particularly simple in manipulation.

A particularly preferred application of the invention is characterized in that the endless conveyor is a bobbin supply and removal means for the spinning points or positions of a ring spinning machine while the bobbin peg trays have pegs which extend substantially upwards and particularly at least substantially vertically. In a ring spinning machine particularly exact positioning relative to the spinning stations is essential and consequently, the invention can be used with particular advantage here.

In another embodiment, the endless conveyor may be a return conveyor belt for emptying flyer bobbins in a ring spinning machine. In this embodiment, a plurality of bobbin pegs are provided with each peg being secured to and projecting from a respective driver for slidably receiving an adaptor having a full bobbin suspending therefrom. In this embodiment, the bobbin pegs can be aligned with a transverse rail of a bobbin containing lattice forming a bobbin supporting arrangement in such a manner that a support and a guide adapter hanging from the transverse rail can be shifted onto a bobbin peg. In this case, each adaptor would carry an empty bobbin or a full bobbin at the lower end in a suspended manner.

Figure 4:
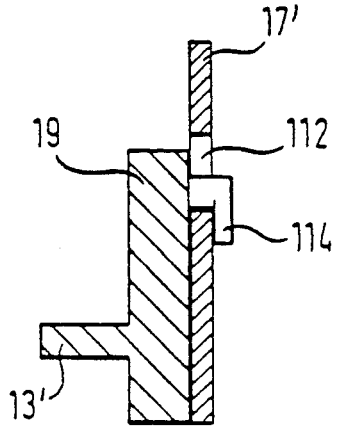
Figure 5:
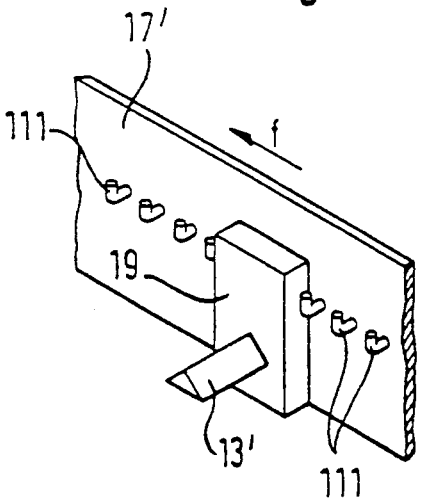
Figure 6:
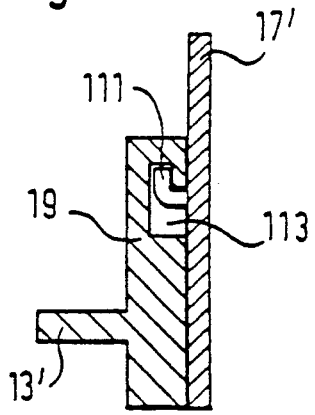
Figure 7:
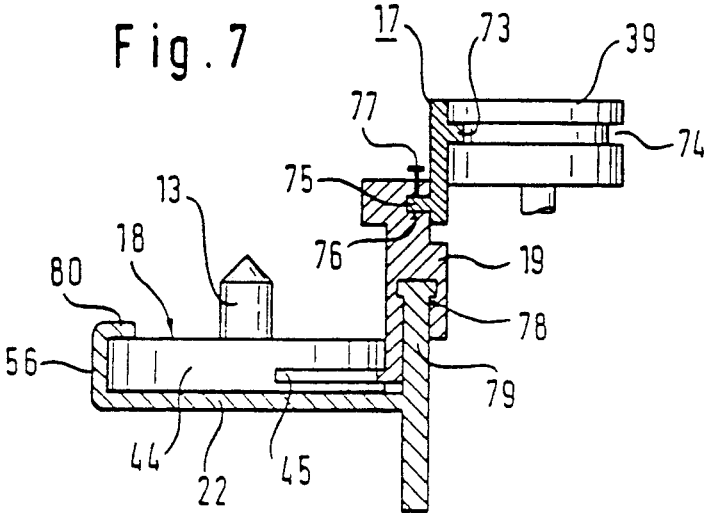
Figure 8:
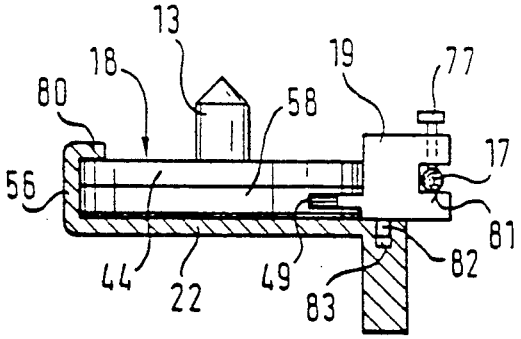
Figure 9:
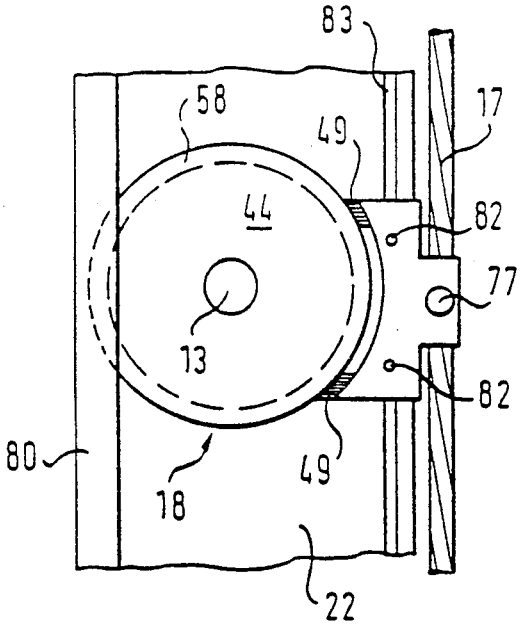
Figure 10:
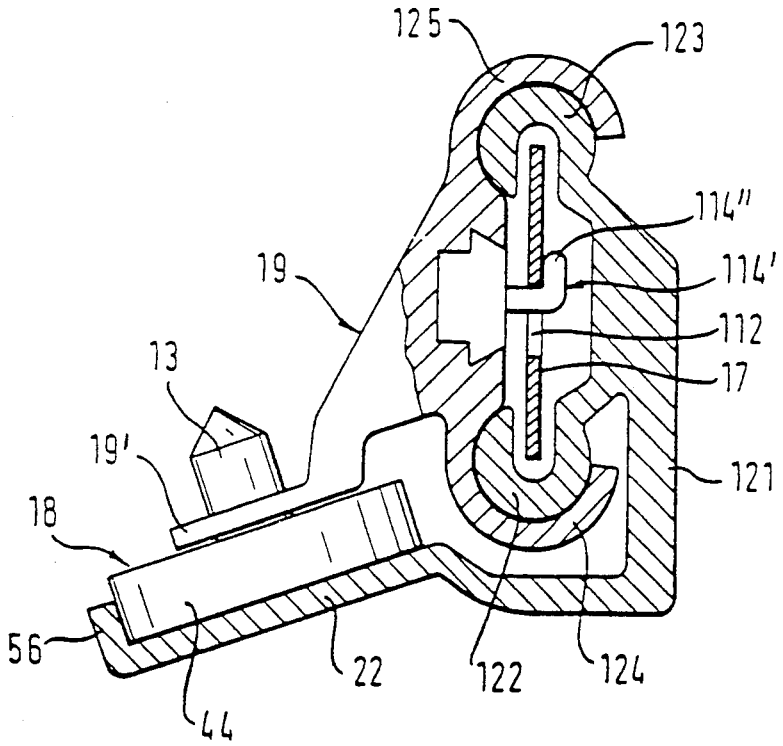
Figure 12:
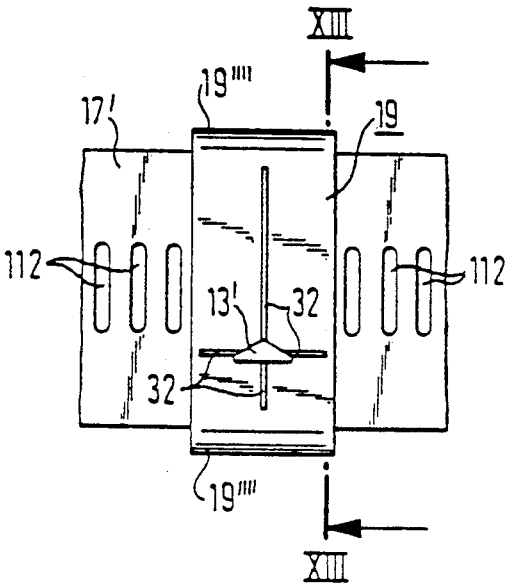
Figure 13:
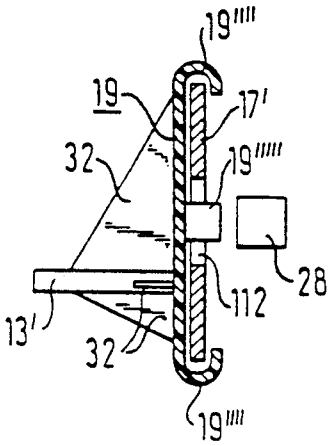
Figure 14:
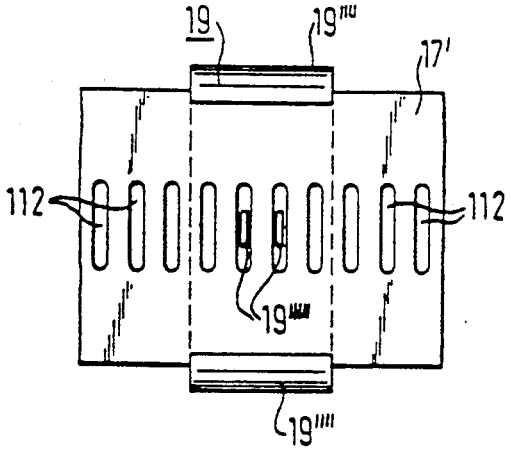
Figure 15:
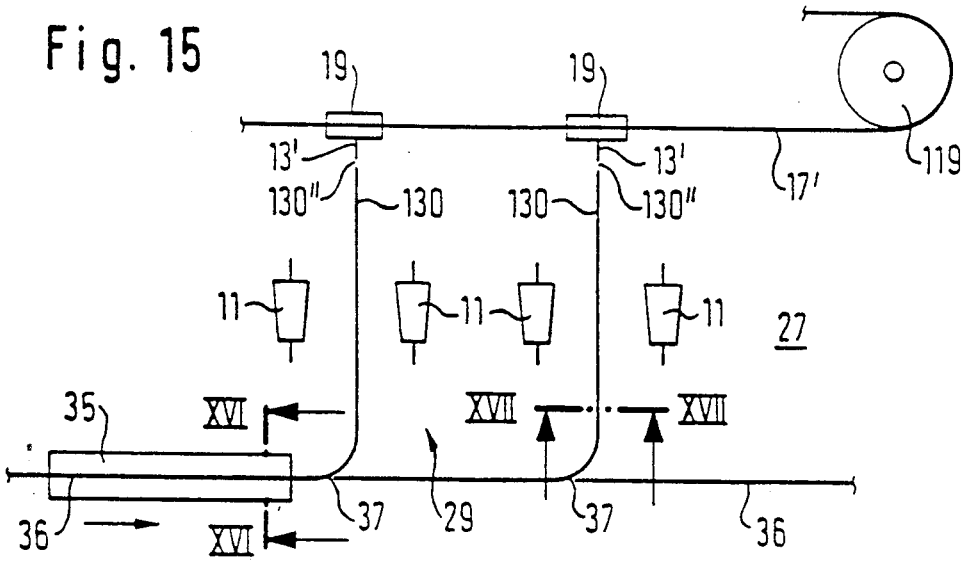
Figure 16:
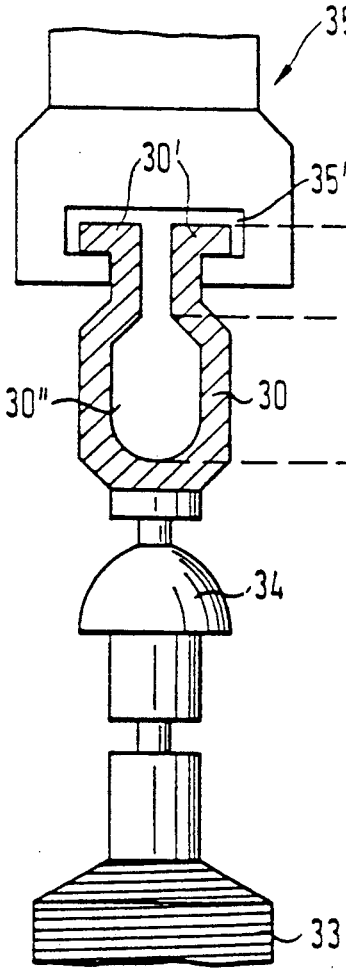
Figure 17:
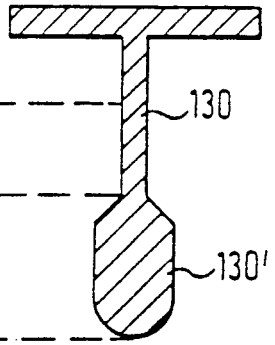
Figure 18:
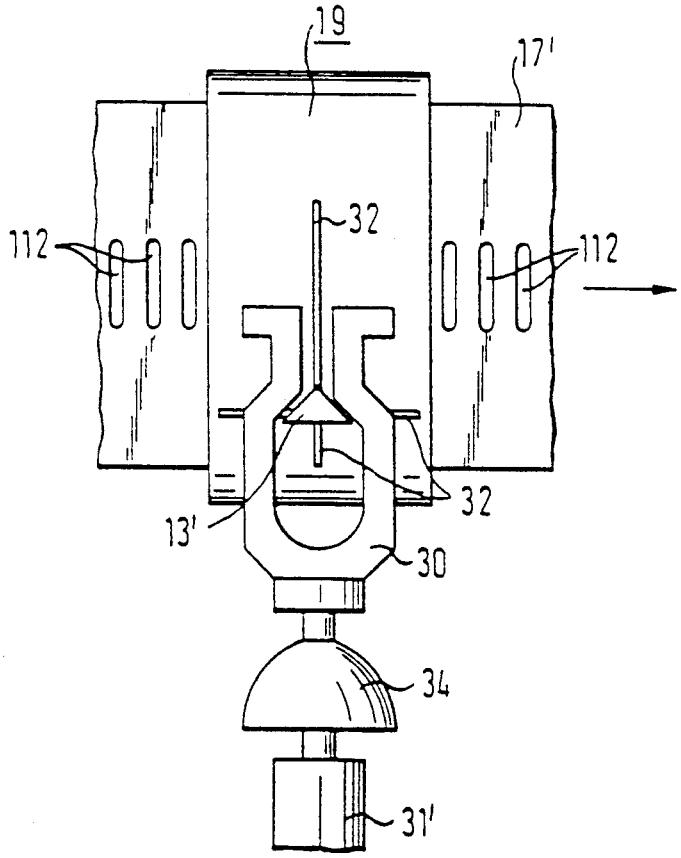

The invention will be described hereinafter by way of example with the aid of the drawings, wherein:

FIG. 1 shows a schematic front elevation of part of a ring frame with endless conveyor according to the invention in front of said frame, FIG. 2 is a section along the line II—II of FIG. 1, FIG. 3 is a perspective partial view of a fragment of a return transport belt equipped with a driver for empty flyer bobbins in a ring spinning machine which is constructed as an endless conveyor according to the invention, FIG. 4 is a schematic section through the endless conveyor and the driver according to FIG. 3 perpendicularly to the conveying direction, FIG. 5 shows a perspective view similar to FIG. 3 but with projections provided on the return transport belt instead of holes, FIG. 6 is a section through the arrangement according to FIG. 5 perpendicularly to the conveying direction, FIG. 7 is a section through the endless conveyor, the driver and the bobbin peg arrangement of a further embodiment perpendicularly to the conveying direction, FIG. 8 is a corresponding section of another embodiment, FIG. 9 is a plan view of the subject of FIG. 8, FIG. 10 is a section perpendicular to the conveying direction of a further embodiment, FIG. 11 is a schematic plan view of a ring spinning machine equipped with endless conveyor according to the invention, FIG. 12 a front view of return conveyor belt for flyer bobbins having an attached driver according to another embodiment, FIG. 13 a section according to line XIII—XIII in FIG. 12, FIG. 14 a rear view of the subject matter of FIG. 12, FIG. 15 a purely schematic partial plan view of a ring spinning machine according to the invention for illustrating the supply and removal of full and empty flyer bobbins, respectively, FIG. 16 a section according to line XVI—XVI in FIG. 15, FIG. 17 a section according to line XVII—XVII in FIG. 15 and FIG. 18 a front view of a driver with suspended empty bobbin being attached to the endless conveyor belt 17'.

In accordance with FIGS. 1 and 2, an endless conveyor is disposed in front of one machine side of a ring spinning machine or frame 27 with spinning points 11 arranged at equal intervals. The endless conveyor is in the form of a vertically arranged steel belt or band 17 which in accordance with FIG. 11 is led endlessly via guide rollers 39, 40, 41, 42 round the ring spinning machine 27 with spinning points 11 arranged on both sides. On the endless conveyor 17, in alignment with the individual spinning points 11 of the ring spinning machine 27, drivers 19 are arranged which in accordance with FIGS. 1 and 2 have a vertical plate portion 19'' extending parallel to the conveyor band or belt 17 and a hook portion 19''' bent in U-manner from above over the conveyor belt 17 so that a downwardly open slot 115 is formed having a form complementary to the conveyor belt 17.

Opposite the hook portion 19''' a clamp screw 77 is screwed into a threaded bore 116 of the plate portion 19'' and with its end facing the conveyor belt 17 bears on the latter and thus clamps the hook portion 19''' against the conveyor belt 17. The clamp screw 77 thus functions as a means for adjustably mounting the driver 19 on the conveyor belt 17. After releasing the screw 77, the driver 19 can be displaced in or against the conveying direction f relative to the conveyor belt 17 and this is done until exact alignment with the associated spinning point 11 is achieved. The clamp screw 77 is then immediately tightened and the driver 19 thus fixed on the conveyor belt 17.

The clamp screw 77 and the hook portion 19''' are disposed in the upper edge region of the conveyor belt 17 where the plate portion 19'' and the hook portion 19''' according to FIG. 1 have the smallest possible width B to ensure easy guiding of the conveyor band 17 round the guide rollers 39, 40, 41, 42 which extend in accordance with the dashed-line representation in FIG. 2 axially only up to the lower end of the hook portion 19''' so that the flat area engagement of the conveyor belt 17 on the periphery of the guide rollers 39, 40, 41, 42 is not obstructed by the drivers 19.

A driver finger 19' extends from the lower end of each driver 19 perpendicularly to the conveyor belt 17 and away from the latter and engages behind the foot 13' of a vertically disposed bobbin peg 13 which projects vertically upwardly from a horizontal cylindrical sliding body 44 which is arranged slidingly on a support rail 22 extending horizontally parallel to the endless conveyor 17. The sliding body 44 and the bobbin peg 13 together form a peg tray 18.

According to FIG. 2 the support rail 22, which is fixed with respect to the machine, may further comprise at its outer side a lateral guide 56 which to hold the sliding body 44 from above as well may be provided with an upper angled portion 80.

Possibly, on the inner side of the support rail 22 a lateral guide 117 could also be provided so that the peg trays 18 are slidingly guided all round parallel to the endless conveyor 17.

Empty bobbins 31 (FIG. 2) or yarn-carrying full bobbins can be put onto the bobbin pegs 13 to be conveyed from and to a spool machine, respectively, not represented in the drawing.

The mode of operation of the spinning machine described with the endless conveyor is as follows:

Firstly, the conveyor belt 17 equipped provisionally with the drivers 19 is placed round the guide rollers 39, 40, 41, 42 of the ring spinning machine 27 in the manner indicated in FIG. 11. Then, for example by a controlled displacement of the guide rollers 41, 42 in the direction of the arrows S, the desired tension of the steel conveyor belt or band 17 may be established, as a result of which the conveyor belt 17 stretches somewhat. The conveyor belt 17 is now brought into the bobbin change position in which, in each case, a specific support peg 13 is to be arranged exactly in alignment with the associated spinning point 11. After the conveyor band 17 has been brought into the bobbin change position, with engagement of a peg tray 18 on each driver finger 19', the associated drivers 19 are moved, after releasing the clamp screw 77, in or opposite to the conveying direction f until the associated bobbin peg 13 is located in exact alignment with the associated spinning point 11. This exact alignment is carried out successively at all spinning stations. After a specific bobbin peg 13 has been exactly aligned with the associated spinning point 11, the clamp screw 77 is tightened again so that the exact positioning of the respective dog or driver 19 is permanently secured.

If after relatively long operation any distortions of the conveyor belt 17 should occur the exact alignment of each driver 19 with the associated spinning point 11 can be re-established at any time by again releasing the clamp screw 77 and corresponding relative displacement with respect to the conveyor belt 17.

FIG. 11 also shows schematically a vertical endless conveyor belt 17' arranged in the center of the ring spinning machine and extending in the machine longitudinal direction for the return transport of empty flyer bobbins 31' (FIG. 18) which are supplied through bobbin support arrangements 120. This endless conveyor belt 17' is guided at the ends of the ring spinning machine 27 via guide rollers 118, 119 with vertical axes and is formed by a steel band with a vertically disposed planar surface. Drivers 19 with empty bobbin pegs 13' are mounted on the band in defined intervals variable however in accordance with the invention, the empty bobbin pegs 13' extending in the present case away from the endless conveyor belt 17' horizontally. For clarity, in FIG. 11 only three such drivers 19 with support pegs 13' are indicated.

Other means for adjustably mounting each driver on the conveyor are further illustrated in FIGS. 3 to 14 as described below.

FIG. 3 shows a perspectively illustrated fragment of a return transport band or belt 17' with a driver 19 disposed thereon which carries a bobbin peg 13' projecting forwardly and having a roof-like section.

In accordance with FIG. 3 and 4, in the upper region the driver 19 comprises at its rear side one or preferably two adjacent hook-like counter projections 114 which engage in rectangular holes 112 of the return transport belt 17' so that the driver 19 is suspended on the return transport belt 17'. Analogously to FIG. 2 the guide rollers are to be arranged axially beneath the counter projections 114 to avoid colliding with the latter. For this reason, the holes 112 should be provided as far up as possible in the return transport belt 17'.

It is also possible to provide grooves in the periphery of the guide rollers for receiving the rearwardly projecting part of the counter-projections 114.

The holes 112 are arranged in relatively close intervals on a line extending parallel to the longitudinal extent of the return transport belt 17' so that the driver 19 can be attached at different points to the return transport belt 17' by suspension in adjacent holes 112 in or opposite to the conveying direction f. In this manner, the drivers 19 and the bobbin pegs 13' can be brought into exact alignment with bobbin support arrangements 120 from which the empty flyer bobbins 31' (FIG. 18) are to be removed, which will be described further below in connection with FIG. 15 to 18.

According to FIGS. 5 and 6, at the front side of the return transport belt 17', hook-like projections 111 may be provided also at equal intervals and cooperate with corresponding depressions 113 at the rear side of the drivers 19. Preferably, a driver 19 is suspended on two spaced-apart hook-like projections 111.

The width of the holes 112 and/or of the projections 111 is 0.5 mm to 1.5 mm, particularly 1 mm. The distance and the graduation, respectively, of the periodically repeated holes 112 and projections 111, respectively, is about 2 to 3 mm, particularly 2.5 mm.

FIG. 12, 13 and 14 show a slightly different embodiment of the driver 19 and the bobbin pegs 13' projecting horizontally from the drivers 19. The driver 19 is consisting of plastic material and has a flat, U-shaped section, the two limbs 19'' of the plastic part being clipped over the upper and lower edge of the conveyor belt 17', respectively. At the level of the holes 112 and arranged substantially in the center of the belt 17' are provided iron tongues 19''' at the rear side of the drivers 19, the tongues 19''' engaging one of the holes 112, respectively, in a fitting manner and cooperating with a magnet indicator 28 being fixed at its rear side to the machine. The magnet indicator delivers its signal when it is aligned with one iron tongue 19'''.

From the forward lower region of the driver 19, a bobbin peg 13' extends forwardly and horizontally having a roof-like section. The support capability and stability of the peg 13' is increased by support ribs 32 extending between the peg 13' and the driver 19.

According to FIG. 14 two iron tongues 19''' are provided at the rear side of the flat part of the driver 19 arranged one beside the other at such a distance of e.g. 1 mm that the tongues 19''' engage two adjacent holes 112 of the endless conveyor belt 17'.

In connection with FIG. 15, 16, 17 and 18 it will be described how the flyer full bobbins 33 (FIG. 16) are conveyed to the spinning points and how the empty bobbins 31' (FIG. 18) get to the bobbin pegs 13' of the drivers 19 according to FIG. 3 to 6 and 12 to 14, respectively.

According to FIG. 15 and 16 yarn-carrying full bobbins 33, hung on a trolley 35 by a coupling pin 34 (Casablanca pin) and by a support and guiding adapter 30, get to spinning points 11 of the ring spinning machine 27 in that the trolley 35 carrying a plurality of full bobbins 33 advances along the rails 36 extending along the ring spinning machine 27 and delivers one or two full bobbins through shunts 37 to transverse rails 130 belonging to the bobbin transport lattice 29. There the full bobbins 33 will be connected with the spinning points in that the roving is supplied to the stretching means not represented in the drawings.

The support and guiding adapter 30 can be hung from the underside of the trolley 35 in guiding cavities 35' by means of angle means 30' on the one hand but can also be guidingly shifted to a guiding area 130' of the transverse rails 130 due to its hollow profile 30'' (FIG. 16, 17).

According to FIG. 15 the bobbin pegs 13' of the drivers 19 mounted at the transport belt 17' can be aligned with the transverse rails 130 in the bobbin change position in that the drivers 19 are hung at the correct place onto the transport belt 17' wherein the fine graduation of the holes 112 (FIG. 3 and 12, 14) is utilized.

When the transverse rails 130 and the bobbin pegs 13' (FIG. 15) are exactly aligned, the empty bobbins 31' can be shifted from the transverse rails 130 to the associated bobbin pegs 13' according to FIG. 18. Between the bobbin pegs 13' and the opposite end of the transverse rail 130 there is such a narrow gap 130'' (FIG. 15) that the support and guiding adapter 30 can be easily shifted from the transverse rails 130 to the bobbin peg 13' whereupon the position according to FIG. 18 is obtained. If the endless conveyor belt 17' is then moved in the direction of the arrow in FIG. 17 the empty bobbins 31' hanging at the support and guiding adapter 30 will be transported away from the spinning points 11 and back to the flyer.

The above-mentioned graduation of about 2.5 mm for the holes 112 is sufficient since thereby the maximum tolerance is $\pm 1.25$ mm which is satisfactory in view of the usual guiding tolerances. The same measures and tolerances are valid for the cops belt 17.

The drivers 19 according to FIG. 12 to 14 consist of plastic material because they should be light and cheap. The tongues 19''' however have to be made of metal because the endless conveyor belt 17' is a steel belt and otherwise too much wear would occur. The two iron tongues 19''' according to FIG. 12 to 14 are spaced according to the graduation of 2.5 mm. It would, however, be also possible to leave a free hole 112 between the two iron tongues 19''' whereby the spacing of the iron tongues in conveying direction would amount to 5 mm. The magnetic indicator 28 is used for stopping the endless conveyor belt 17'. It has turned out that the reliability is remarkably increased if two iron tongues 19''' are present at one driver 19.

Two further advantageous embodiments for the longitudinally adjustable attachment of the driver 19 to the endless conveyor 17 will be described hereinafter with reference to FIGS. 7 to 9. This embodiment is particularly suited for the removal of copses and the supply of corresponding empty bobbins to the spinning points 11.

In the example of embodiment according to FIG. 7, the vertical steel conveyor band or belt 17 includes a tongue 73 which projects inwardly towards the guide roller 39 and engages in a peripheral groove 74 of the guide roller 39. The remaining guide rollers 40, 41, 42 have corresponding peripheral grooves 74. With this measure, perfect vertical alignment can be achieved between the steel band 17 and the guide rollers.

In the lower region, the vertically upright conveyor belt 17 includes an outwardly projecting tongue 75 which, displaceable in the conveying direction, engages into a corresponding groove 76 of the driver 19. By clamp means 77, indicated schematically, the driver 19 can be locked in different longitudinal positions relatively to the conveyor belt 17. In this manner, a longitudinal adjustment of the driver 19 relative to the endless conveyor 17 is possible.

In its lower region, the driver 19 comprises a T-shaped guide recess 78 by means of which it bears slidingly on a profile 79 complementary thereto and having a T cross-section. The T-profile is fixedly connected to the support rail 22 and the lateral guide 56, i.e. fixed with respect to the machine. By means of this guide of the drivers 19, the latter and the conveyor belt 17 are satisfactorily supported and guided between the guide rollers 39, 40, 41, 42 in the vertical direction as well.

The cylindrical sliding body 44 of the peg tray 18 is slidingly mounted on the support rail 22 and is advanced by the driver finger 45 of the driver 19 when the endless conveyor 17 is set in rotation.

The lateral guides 56 are further bent at their upper end to form a guide edge 80 so that the sliding bodies 44 are secured from above against lifting and can only be moved in the desired conveying direction.

According to FIGS. 8 and 9, the endless conveyor 17 is formed by a circulating steel cable to which the drivers 19 provided with corresponding receiving grooves 81 are clamped in a desired longitudinal position by clamp means 77. In this manner as well, the drivers 19 can be secured in longitudinally variable position to the endless conveyor 17. In this embodiment permanent magnets 49 are provided on the drivers 19 which cooperate with a magnetic insert 58 at the periphery of the sliding body to hold the peg tray 18 detachably on the driver 19.

From the underside of the driver 19, guide pins 82 fixed with respect to the driver extend downwardly into a longitudinal groove 83 of the support rail 22 and in cooperation with the lateral guiding 56 on the opposite side, this ensures perfect longitudinal guiding of the peg trays 18.

According to FIG. 10, the support rail 22 with the lateral guide 56 is arranged declining downwardly outwardly somewhat. The bobbin peg 13 projects, however, still substantially upwardly.

From the support rail 22, a profile 121 extends in the manner illustrated round the conveyor belt 17 with spacing and receiving beads 122, 123 which extend at the bottom and top parallel to the conveyor belt or band 17 and on which holding shells 124, 125 of a driver 19 are fitted slidingly in the conveying direction.

A hook-like counter projection 114' extends from the driver 19 to the conveyor belt 17 and passes through one of the holes 112 of the conveyor belt 17 formed analogously to FIGS. 3 and 4 in such a manner that the upwardly projecting hook-like portion 114'' of the counter projection 114' comes to bear on the conveyor belt. 17 from the rear.

Since the driver 19 is supported via the upper shell 125 on the upper bead 123, in this case the driver 19 via the hook-like counter projection 114' carries the conveyor belt 17 so that the latter exerts only a purely entraining function and need not be particularly guided, apart from at the guide rollers 39, 40, 41, 42. The driver finger 19' is again provided on the driver 19 for entraining the peg tray 18.

We claim:

1. A spinning machine comprising a plurality of spinning positions disposed at predetermined intervals;

an endless conveyor disposed for travel along said spinning positions;

a plurality of drivers mounted on said conveyor at intervals corresponding to said predetermined intervals of said spinning positions;

means for adjustably mounting each driver on said conveyor to be individually adapted to a respective spinning position;

a support rail extending along said spinning positions; and a plurality of bobbin peg trays slidably mounted on said support rail, each peg tray being in contact with a respective driver for pushing of said peg tray along said rail in response to movement of said conveyor.

2. A spinning machine as set forth in claim 1 wherein said conveyor is a vertically disposed belt.

3. A spinning machine as set forth in claim 1 wherein said conveyor is made of steel.

4. A spinning machine as set forth in claim 1 wherein each means comprises a releasable clamp connection on each respective driver for releasably clamping said driver to said conveyor.

5. A spinning machine as set forth in claim 1 wherein said conveyor has a longitudinally disposed tongue and each driver has a groove slidably receiving said tongue.

6. A spinning machine as set forth in claim 5 wherein each means comprises a releasable clamp connection on each respective driver for releasably engaging said tongue of said conveyor.

7. A spinning machine as set forth in claim 1 wherein said conveyor is a vertically disposed belt and each driver has a hook portion engaging over said belt and said means is a releasable clamp connection on each respective driver for releasably engaging said belt.

8. A spinning machine as set forth in claim 1 wherein said conveyor is a steel cable and each driver has a groove receiving said cable and said means is a releasable clamp connection on each respective driver for releasably engaging said cable.

9. A spinning machine as set forth in claim 1 wherein said conveyor is a belt and said means includes a plurality of equi-spaced slots in said belt and a projection on each driver for selectively fitting in one of said slots to adjustably mount said respective driver on said belt.

10. A spinning machine as set forth in claim 1 wherein said conveyor is a belt and said means includes a plurality of equi-spaced projections on said belt and a slot on each driver for selectively receiving at lest one of said projections.

* * * * *